US006464157B1

(12) United States Patent
Balvanz et al.

(10) Patent No.: US 6,464,157 B1
(45) Date of Patent: Oct. 15, 2002

(54) REMOVABLE HAMMERS FOR USE WITH A ROTOR AND HAMMER ASSEMBLY

(75) Inventors: Loran R. Balvanz; Paul R. Gray, both of New Providence, IA (US)

(73) Assignee: U.S. Manufacturing, Inc., New Providence, IA (US)

( * ) Notice: Subject to any disclaimer, the term of this patent is extended or adjusted under 35 U.S.C. 154(b) by 0 days.

(21) Appl. No.: 09/834,847

(22) Filed: Apr. 13, 2001

(51) Int. Cl.[7] ..... B02C 13/02
(52) U.S. Cl. ..... 241/191; 241/197; 241/300
(58) Field of Search ..... 241/191, 195, 241/197, 300

(56) References Cited

U.S. PATENT DOCUMENTS

| | | | | |
|---|---|---|---|---|
| 3,680,797 A | | 8/1972 | Covey | |
| 4,136,833 A | | 1/1979 | Knight | |
| 4,702,426 A | | 10/1987 | Citterio | |
| 5,285,974 A | * | 2/1994 | Cesarini | 241/194 |
| 5,307,719 A | * | 5/1994 | MacLennan | 83/839 |
| 5,320,292 A | | 6/1994 | Smith | |
| 5,704,562 A | | 1/1998 | Wagstaff | |
| 5,775,608 A | | 7/1998 | Dumaine et al. | |
| 5,941,467 A | | 8/1999 | McArdle et al. | |
| 5,967,436 A | * | 10/1999 | Balvanz | 241/195 |
| 6,079,649 A | * | 6/2000 | Balvanz et al. | 241/189.1 |
| 6,131,838 A | * | 10/2000 | Balvanz et al. | 241/195 |
| 6,142,400 A | * | 11/2000 | Balvanz et al. | 241/191 |
| 6,311,910 B1 | * | 11/2001 | Balvanz et al. | 241/191 |

* cited by examiner

*Primary Examiner*—Allen Ostrager
*Assistant Examiner*—William Hong
(74) *Attorney, Agent, or Firm*—Daniel A. Rosenberg; Kent A. Herink; Davis Brown Law Firm

(57) ABSTRACT

The invention comprises a rotor and hammer assembly comprising a drive shaft allowing for rotating the rotor and hammer assembly. End plates are secured to the drive shaft, and a rotor casing is secured to the end plates. The rotor casing has an outside surface, to which a hammer is removably secured. The outer surface of the rotor casing includes slots, having a first and second slot section with a raised center portion therebetween. The hammer has a substantially flat base with a centrally located notch, such that the hammer base and the slot matingly align. The hammer is further secured to the outer surface of the rotor casing with threaded bolts. The hammer includes a front face with a raised center section and recessed comers that matingly align with the hammer tip, and is further secured with threaded bolt and nut.

7 Claims, 4 Drawing Sheets

REMOVABLE HAMMERS FOR USE WITH A ROTOR AND HAMMER ASSEMBLY

BACKGROUND OF THE INVENTION

The invention relates generally to a rotor and hammer assembly with a removable hammer for use with a size reducing machine. More specifically, the invention relates to a rotor and hammer assembly comprising a drive shaft with a rotor casing sealed by two end plates, and with a hammer removably secured to the outer surface of the rotor casing.

Impact crushers, like rotary hammermills or tub grinders, and the like, of the type contemplated herein, are widely used to size reduce objects into smaller fragments through rotation of a motor driven rotor. These devices typically include a plurality of hammers attached to the rotor. During operation the rotor spins allowing the hammers to impact, and thereby size reduce material.

Rotor assemblies used in conjunction with size reducing machine (such as tub grinders, rotary hammermills, vertical feed machines, and the like) experience a number of problems associated with the operation and maintenance of the size reducing machines. For example, the powerful and violent interaction between the rotor assembly and the matter being size reduced causes a great deal of wear on any exposed surfaces. Furthermore, the interaction between the material inside the machine and the rotor and hammer assembly is difficult to control in a manner that allows for smooth and efficient operation of the machine.

Further, prior art rotor assemblies utilize a complex arrangement of parts. The parts include a plurality of hammers secured in rows substantially parallel to a drive shaft. The hammers secure to a plurality of plates, wherein each plate orients about the drive shaft. The plates also contain a number of distally located holes. Pins, or rods, align through the holes in the plates and in the hammers. Additionally, spacers align between the plates. All these parts require careful and precise alignment relative to each other. In the case of disassembly for the purposes of repair and replacement of worn or damaged parts, the wear and tear causes considerable difficulty in realigning and reassembling of the rotor parts. Moreover, the parts of the rotor assembly are usually keyed to each other, or at least to the drive shaft, this further complicates the assembly and disassembly process. For example, the replacement of a single hammer can require disassembly of the entire rotor. Given the frequency at which wear parts require replacement, replacement and repairs constitute an extremely difficult and timeconsuming task that considerably reduces the operating time of the size reducing machine. In some cases removing a single damaged hammer can take in excess of five hours, due to both the rotor design and to the realignment difficulties related to the problems caused by impact of debris with the non-impact surfaces of the rotor assembly.

Prior art rotor assemblies expose a great deal of the surface area of the rotor parts to debris. The plates, the spacers, and hammers all receive considerable contact with the debris. This not only creates excessive wear, but contributes to realignment difficulties by bending and damaging the various parts caused by residual impact. Thus, after a period of operation, prior art rotor assemblies become even more difficult to disassemble and reassemble.

In addition, in many cases the size of the hammers and the attached hammer tips may vary based on the type of material processed in the size reducing machines. In this case, all of the hammers may need replacement to accommodate a different design or size, or to allow for attachment of a different size tip. Replacing even one hammer can take considerable time with prior art rotor designs, let alone all of the hammers.

Based on the foregoing, those of ordinary skill in the art will realize that a need exists for a hammer and rotor assembly that allows for replacing hammers in a manner that reduces the amount of maintenance, increases efficient operation, and better utilizes manpower and machine resources

INCORPORATION BY REFERENCE OF RELATED DISCLOSURE

Incorporated herein by reference are the following patents and/or patents applications, which contain material of relevance to the present invention: U.S. patent application Ser. No. 09/436,951 entitled PRODUCTION PLUS HAMMER WITH PROTECTIVE POCKET filed on Nov. 9, 1999, now U.S. Pat. No. 6,311,910; U.S. patent application No. 09/326,209 entitled SADDLE-BACK HAMMER TIP filed on Jun. 6, 1999, now U.S. Pat. No. 6,131,838 issued on Oct. 17, 2000; and U.S. patent application Ser. No. 09/666,360 entitled SADDLE-BACK HAMMER AND HAMMER TIP filed on Aug. 20, 2000.

SUMMARY OF THE INVENTION

An object of the present invention comprises providing a rotor and hammer assembly with a removable hammer for use with a size reducing machine.

These and other objects of the present invention will become apparent to those skilled in the art upon reference to the following specification, drawings, and claims.

The present invention intends to overcome the difficulties encountered heretofore. To that end, the invention comprises a rotor and hammer assembly comprising a drive shaft allowing for rotating the rotor and hammer assembly. End plates are secured to the drive shaft, and a rotor casing is secured to the end plates. The rotor casing has an outside surface, to which hammer is removably secured.

DETAILED DESCRIPTION OF THE INVENTION

Figures 1A, 1B:
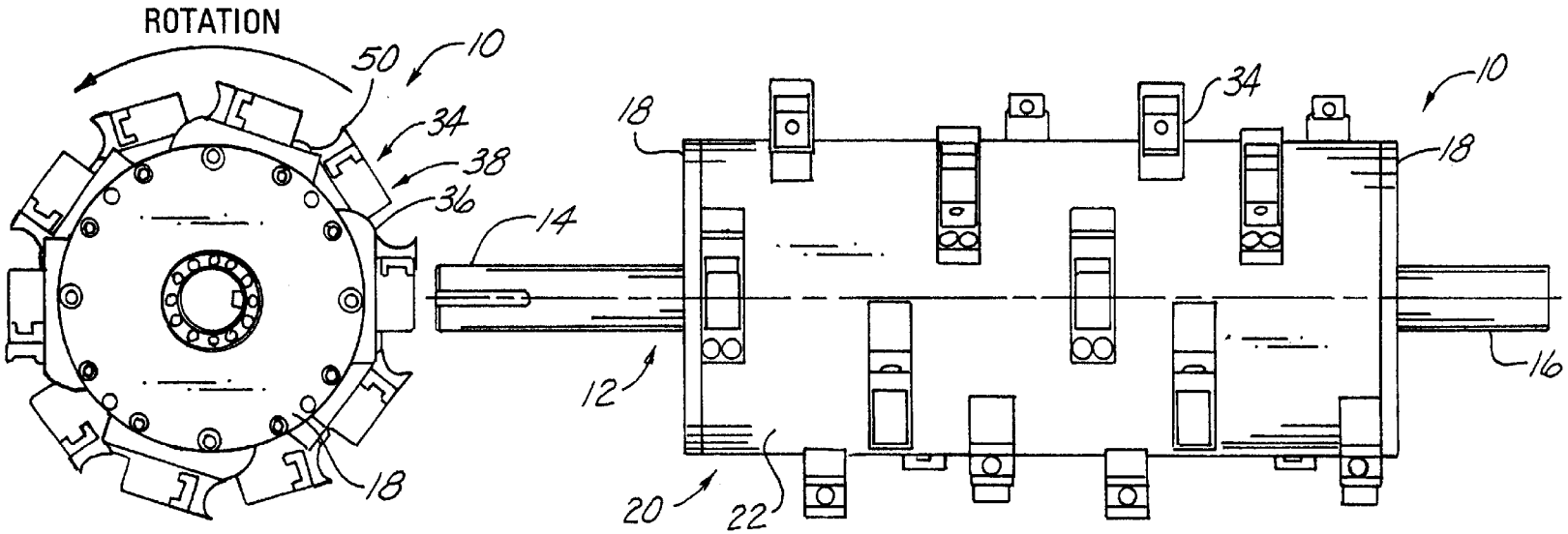
FIG. 1*a* is an end view of a rotor and hammer assembly.
FIG. 1*b* is a side view of the rotor and hammer assembly.

In the figures, FIG. 1*a–b* show a rotor and hammer assembly 10 that includes a drive shaft 12, end plates 18, and a rotor casing 20. The drive shaft 12 includes a drive end 14 for securing to a drive motor (not shown) of a size reducing machine (not shown), and an outboard end 16 opposite thereto. The end plates 18 secure to the drive shaft 12 and the rotor casing 20 encloses the assembly 10 such that the rotor casing 20 has an outer surface 22.

Figure 2B:
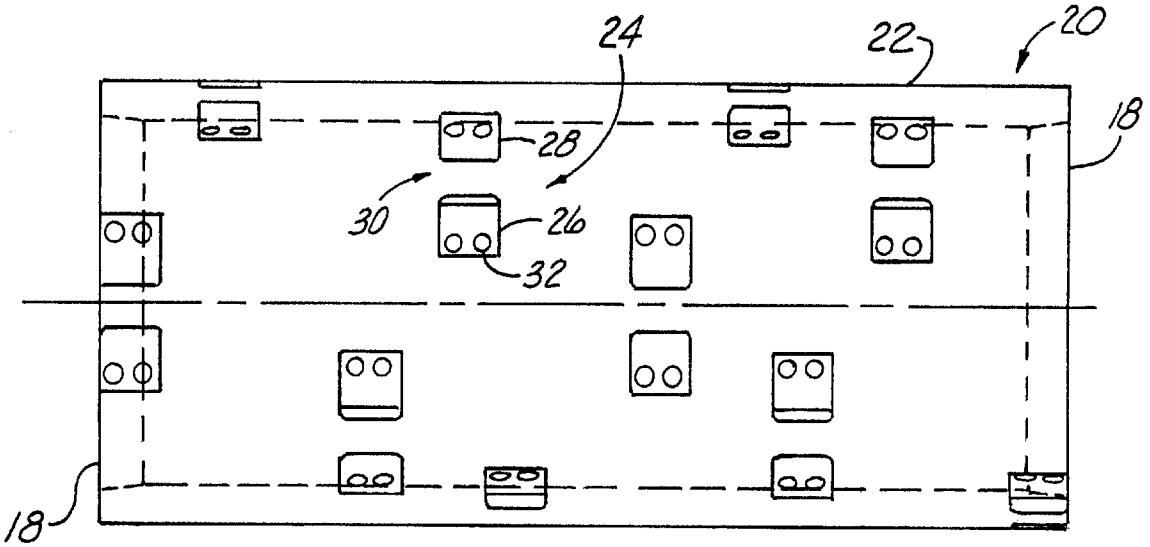
FIG. 2*b* is a side view of the rotor casing.
Figure 2A:
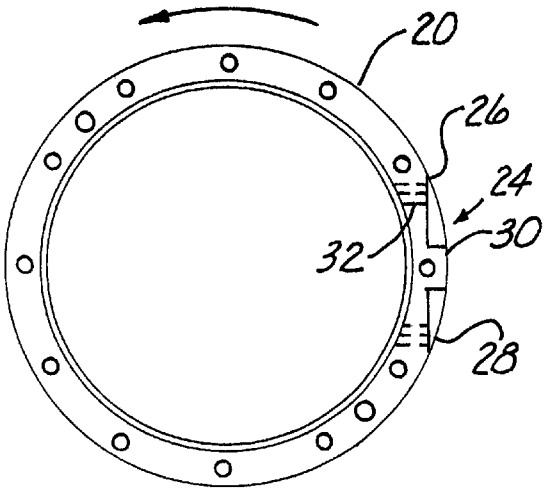
FIG. 2*a* is an end view of a rotor casing of the rotor and hammer assembly.

Arranged about the outer surface 22 of the rotor casing 20 are a plurality slots 24. (See FIG. 2*a–c*) In particular, the slots 24 include a first slot section 26 and a second slot section 28, with a raised center portion 30 therebetween. Shown best in FIG. 3, the first and second slot sections 26, 28 consist of parallel indentations in the outer surface 22 of the rotor casing 20, and the raised portion 30 separates the first and second slot sections 26, 28. Additionally, the slots include a plurality of threaded boltholes 32.

The assembly 10 also includes a plurality of hammers 34 (see FIGS. 4*a–d*, FIG. 3) that are configured for mating alignment with the slots 24 of the outer surface 22 of the rotor casing 20. In particular, the hammers 34 include a base 36 and an upper portion 38. The base 36 of the hammer 34 includes a substantially flat lower surface divided into two distinct sections by notch 40. In this manner the base 36 of the hammer 34 aligns with the slots 24 of the outer surface 22 of the rotor casing 20, such that the first and second slot sections 26, 28 align with the substantially flat sections of the base 36, and the raised center portion 30 of the slots 24 fits within the notch 40 of the base 36 and the hammer 34 (see FIG. 3). Additionally, the hammers 34 include a plurality of recessed boltholes 42 that align with the threaded boltholes 32 of the slots 24. Bolts (not shown) can then removabaly secure the hammers 34 to the outer surface 22 of the rotor casing 20. The base 36 of the hammer 34 also includes a curved front portion 41 that serves as a transition between the outer surface 22 of the rotor casing 20 and the upper portion 38 of the hammer 34, and in particular the hammer tips/inserts 50. The curved front portion 41 of the base 36 of the hammer 34 will serve to deflect and direct debris toward the hammer tips 50, and also provides some protection to the base 36 and the hammer 34 against damage due to debris impact. The hammer tip 50 is secured to the hammer 34 with a bolt and nut combination, wherein the bolt (not shown) is inserted in the respective bolt holes 58, 60 in the hammer tip 50 and hammer 34.

Returning to FIGS. 4*a–d*, the upper portion 38 of the hammer 34 includes a front face 44 designed for mating alignment with the back surface 52 of the hammer tips 50. In particular, the front face 44 includes a raised center section 46 that runs the length of the front face 44 along the transverse axis of the front face 44. Additionally, the front face 44 includes recessed comers 48 that are precision milled such that the front face 44 essentially includes a secondary raised section 47 that runs along the longitudinal axis of the front face 44.

Figure 3:
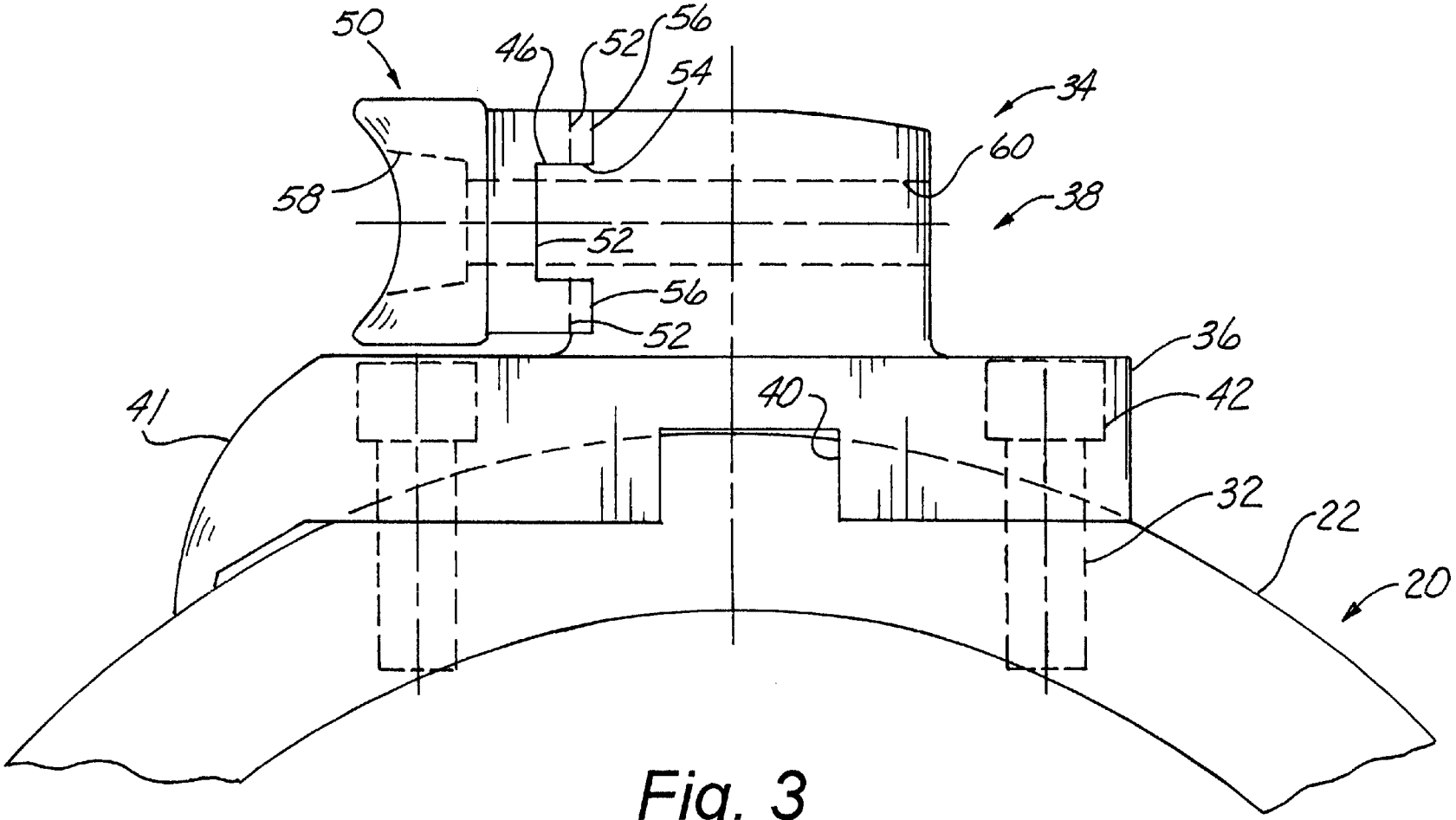
FIG. 3 is a cross-sectional view of a portion of the rotor and hammer assembly.
Figure 4B:
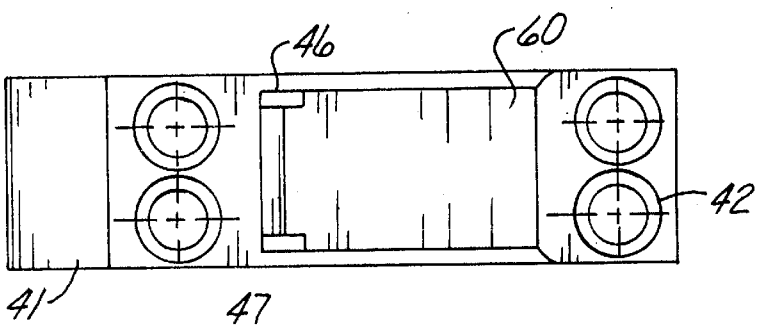
FIG. 4*b* is a top view of the hammer.
Figure 4C:
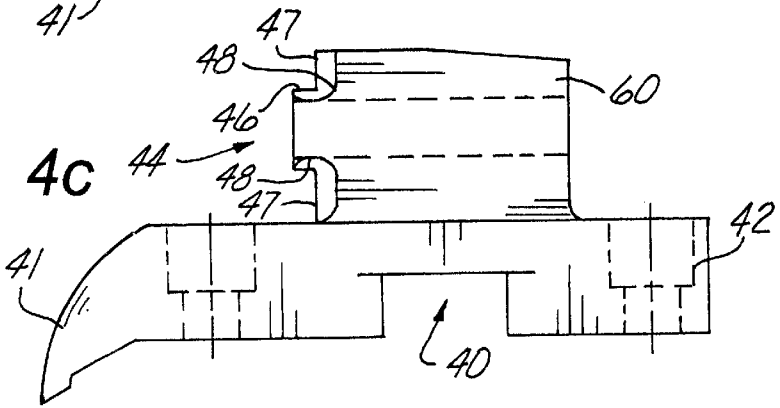
FIG. 4*c* is a side view of the hammer.
Figure 4D:
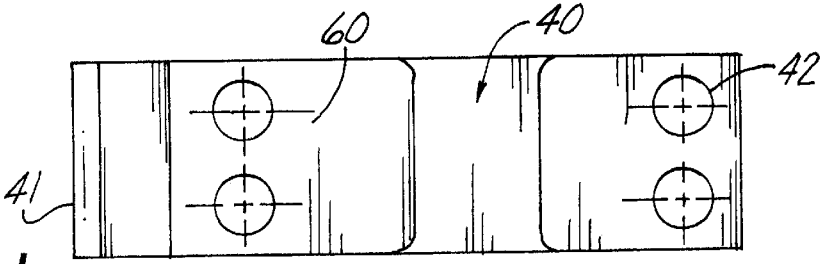
FIG. 4*d* is a bottom view of the hammer.
Figure 4A:
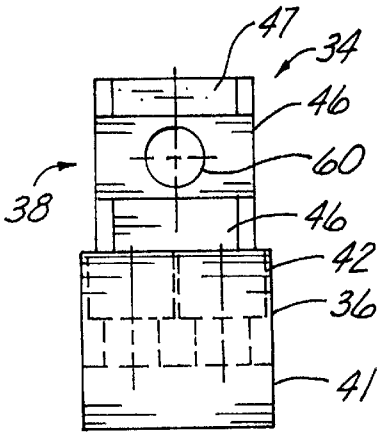
FIG. 4*a* is an end view of a hammer of the rotor and hammer assembly, with the hammer tip removed.

The hammer tips 50 are designed for mating alignment with the front face 44 of the upper portion 38 of the hammer 34 (see FIG. 3). In particular, the hammer tips 50 include a back surface 52 with a recessed notch 54 configured for alignment with the raised center section 46 of the front face 44 of the upper portion 38 of the hammer 34. Additionally, the hammer tips 50 include shoulders 56 located on the outside comers of the back surface 52 that align with the recessed comers 48 of the front face 44 of the upper portion 38 of the hammer 34. The shoulders 56 of the hammer tips 50 are designed to fit around and grip the sides of the longitudinal raised center section 47, and fit around the top and bottom of the transverse raised section 46. In this fashion, the hammer tips 50 secure to the hammers 34 to resist the rotational forces that might tend to loosen or dislodge the hammer tips 50 upon impact with debris during operation (see U.S. patent application Ser. No. 09/326,209 and 09/666,360 for additional detail). The hammer tips 50 also include a bolt hole 60 that extends through the upper portion 38 of the hammers 34. Bolts (not shown) affix the hammer tips 50 to the hammers 34.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

What is claimed is:

1. A rotor and hammer assembly with removable hammers for use with a size reducing machine, said assembly comprising:

a drive shaft for rotating said assembly;

end plates secured to the ends of said drive shaft;

a rotor casing secured to said ends plates, wherein said rotor casing further comprises a plurality of slots in an outer surface of said rotor casing, wherein each of said slots comprises a first and a second slot section with a raised portion therebetween, and said outer surface of said rotor casing further comprises a plurality of threaded bolt holes;

a plurality of hammers removably secured within said slots of said outer surface of said rotor casing, wherein said hammer further comprise:

a substantially flat base with a centrally located notch such that said first and said second slot sections of said slots of said outer surface of said rotor casing align with said substantially flat base of said hammer, and said raised center of said slots of said outer surface of said rotor casing aligns with said notches of said bases of said hammers, and said base of said hammer has a plurality of bolt holes aligned with said threaded bolt holes in said outer surface of said rotor casing;

a plurality of bolt holes in said base; and an upper portion extending from said base with a front face, wherein said front face of said upper portion of said hammer comprises a raised center section along the transverse axis of said front face and recessed comers;

a plurality of threaded bolts removably securing said hammers through said bolt holes in said base of said hammer and through said threaded bolt holes in said outer face of said rotor casing; and a plurality of hammer tips removably secured to said front face of said hammers with a threaded bolt and nut, wherein said hammer tips have a back surface with a recessed notch for alignment with said raised center section of said front face of said upper portion of said hammers and shoulders for alignment with said recessed comers of said front face of said upper portion of said hammers.

2. A rotor and hammer assembly with a removable hammer for use with a size reducing machine, said assembly comprising:

a drive shaft for rotating said assembly;

end plates secured to the ends of said drive shaft;

a rotor casing secured to said ends plates, wherein said rotor casing further comprises a first slot and a second slot with a raised center section therebetween in an outer surface of said rotor casing;

a hammer removably secured within said slots of said outer surface of said rotor casing with threaded bolts; and a hammer tip removably secured to a front face of said hammer with a threaded bolt and nut.

3. The invention in accordance with claim 2 wherein said hammer further comprises a substantially flat base with a centrally located notch such that said first and said second slot sections in said outer surface of said rotor casing align with said substantially flat base of said hammer, and said raised center of said slot of said outer surface of said rotor casing aligns with said notch of said base of said hammer.

4. The invention in accordance with claim 2 wherein said hammer further comprises a plurality of bolt holes, an d said outer surface of said rotor casing further comprises a plurality of threaded bolt holes aligned with said hammer bolt holes, and a plurality of threaded bolts removably securing said hammer to said outer surface of said rotor casing through said bolt holes.

5. The invention in accordance with claim 2 wherein said hammer further comprises a base for removable securement to said outer surface of said rotor casing and an upper portion extending from said base wherein said front face of said hammer is positioned on said upper portion of said hammer, and said front face of said upper portion of said hammer comprises a raised center section along the transverse axis of said front face and recessed comers.

6. The invention in accordance with claim 5 wherein said hammer tip has a back surface with a recessed notch for alignment with said raised center section of said front face of said upper portion of said hammer and shoulders for alignment with said recessed corners of said front face of said upper portion of said hammer.

7. The invention in accordance with claim 2 further comprising a plurality of hammers secured within a plurality of first and second slots in said outer surface of said rotor casing with a plurality of threaded bolts.

* * * * *